US007568421B2

(12) United States Patent
Cummings

(10) Patent No.: US 7,568,421 B2
(45) Date of Patent: Aug. 4, 2009

(54) CARTRIDGE FEEDING ATTACHMENT FOR FIREARMS

(75) Inventor: David C. Cummings, Crouse, NC (US)

(73) Assignee: Rockland, Inc., Bedford, PA (US)

( * ) Notice: Subject to any disclaimer, the term of this patent is extended or adjusted under 35 U.S.C. 154(b) by 248 days.

(21) Appl. No.: 11/604,295

(22) Filed: Nov. 27, 2006

(65) Prior Publication Data

US 2008/0121099 A1 May 29, 2008

(51) Int. Cl.
*F41A 9/00* (2006.01)

(52) U.S. Cl. ..... 89/33.2; 89/33.1; 89/33.25; 42/87

(58) Field of Classification Search ..... 89/33.1, 89/33.25; 42/87
See application file for complete search history.

(56) References Cited

U.S. PATENT DOCUMENTS

| | | | | | |
|---|---|---|---|---|---|
| 2,007,774 | A | * | 7/1935 | Sedgley et al. | 42/50 |
| 2,338,984 | A | * | 1/1944 | Van Horn | 42/50 |
| 2,824,497 | A | * | 2/1958 | Bond et al. | 89/33.25 |
| 3,222,989 | A | * | 12/1965 | Kamp | 89/155 |
| 3,277,787 | A | * | 10/1966 | Brieger | 89/33.25 |
| 4,061,074 | A | * | 12/1977 | Johnson et al. | 89/33.25 |
| 4,487,103 | A | * | 12/1984 | Atchisson | 89/33.02 |
| 4,745,842 | A | * | 5/1988 | Shou-Fu | 89/33.02 |
| 4,926,742 | A | * | 5/1990 | Ma et al. | 89/33.02 |

* cited by examiner

*Primary Examiner*—Michael Carone
*Assistant Examiner*—Samir Abdosh
(74) *Attorney, Agent, or Firm*—Novak Druce & Quigg LLP

(57) ABSTRACT

A cartridge feeding attachment for a firearm generally consisting of a housing attachable to the firearm having means for guiding a stack of cartridges into the cartridge chamber of the firearm along a first line of travel, a follower engageable with one of such cartridges and means disposed between the housing and the follower for biasing the follower along the first line of travel to feed a cartridge into the cartridge chamber; a sprocket supported on the housing having circumferentially spaced recesses each receiving a cartridge of a cartridge belt trained over the sprocket, and a rotational axis positioned so that upon rotational indexing thereof, a cartridge of the belt will be positioned along a second line of travel extending between the follower and a cartridge of the stack of cartridges; means displaceable along the second line of travel extending between the follower and a rearwardmost cartridge of the stack of cartridges; means displaceable along the second line of travel between a retracted position out of engagement with the cartridge of the cartridge belt positioned along the second line of travel and an extended position engaging and displacing such cartridge between the follower and the rearwardmost cartridge of the stack of cartridges; means for biasing the displaceable means in the retracted position; means for transmitting the force of expanding gases resulting from the firing of the firearm to the displaceable means, operable for displacing the displaceable means between the retracted and extended positions; and means responsive to the displacement of the follower upon actuation of the displaceable means for rotationally indexing the sprocket to correspondingly the position another cartridge of the cartridge belt along the second line of travel.

29 Claims, 5 Drawing Sheets

CARTRIDGE FEEDING ATTACHMENT FOR FIREARMS

This invention relates to a firearm and more particularly to an attachment for converting a magazine fed firearm into an automatic belt fed firearm.

BACKGROUND OF THE INVENTION

Conventional firearms primarily used for military and paramilitary purposes typically are either of a magazine fed type or an automatic belt fed type. For reasons of versatility and economy, it has been found to be desirable to be able to convert a magazine fed type of firearm into an automatic belt fed type of firearm. Accordingly, it is the principal object of the present invention to provide an attachment for converting a magazine fed firearm into an automatic belt fed firearm which is simple in design, comparatively inexpensive to manufacture and effective and reliable in performance.

SUMMARY OF THE INVENTION

The principal object of the present invention is achieved by a cartridge feeding attachment for a firearm having a cartridge chamber and a nozzle, generally consisting of a housing attachable to the firearm having means for guiding a stack of cartridges sequentially into the cartridge chamber, along a first line of travel, a follower engageable with a rearwardmost one of the stack of cartridges and means disposed between the housing and the follower for biasing the follower along the first line of travel to feed a forwardmost one of the stack of cartridges into the cartridge chamber, when the housing is attached to the firearm; a sprocket supported on the housing having a plurality of circumferentially spaced recesses each receiving a cartridge of a cartridge belt trained over the sprocket, and a rotational axis positioned so that upon rotational indexing thereof, a cartridge of the cartridge belt will be positioned along a second line of travel extending between the follower and the rearwardmost cartridge of the stack of cartridges; means displaceable along the second line of travel between a retracted position out of engagement with a cartridge of the cartridge belt positioned on a second line of travel, and an extended position engaging and displacing the cartridge between the follower and the rearwardmost cartridge of the stack of cartridges; means for biasing the displaceable means into its retracted position; means for transmitting the force of expanding gases resulting from the firing of a cartridge in the cartridge chamber of the firearm, to the displaceable means, operable for displacing the displaceable means between its retracted and extended positions, against the action of the second mentioned biasing means; and means responsive to the displacement of the follower in the cartridge magazine for rotationally indexing the sprocket to correspondingly position another cartridge of the cartridge belt along the second line of travel.

The attachment functions in a manner whereby it essentially utilizes the force of the expanding gases in the muzzle resulting from a fired cartridge to displace a positioned cartridge of a cartridge belt into the magazine between the rearwardmost cartridge in the magazine and the follower of the magazine, thus causing the follower to displace against a biasing means, and a pawl and ratchet mechanism actuated by the displacement of the follower and operatively connected to the socket for indexing the socket and thus positioning another belt carried cartridge into position to be injected into the magazine.

DETAIL DESCRIPTION OF THE PREFERRED EMBODIMENT

Figure 1:
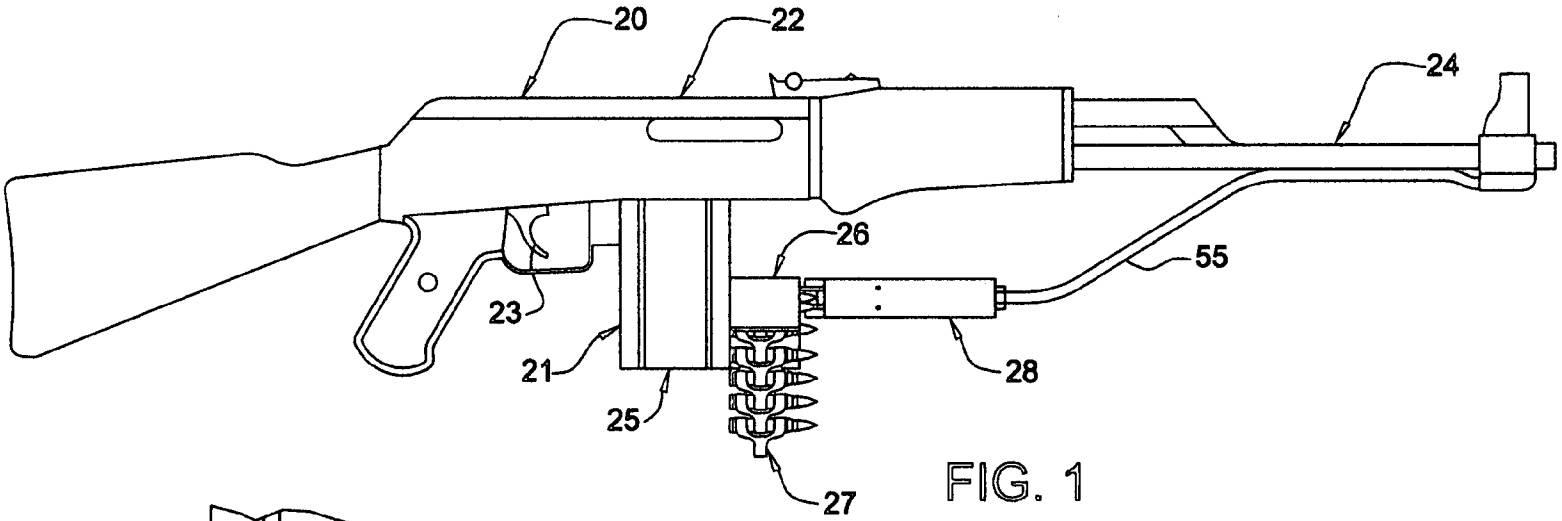
FIG. 1 is a side elevational view of a firearm equipped with an attachment embodying the present invention.
Figure 2:
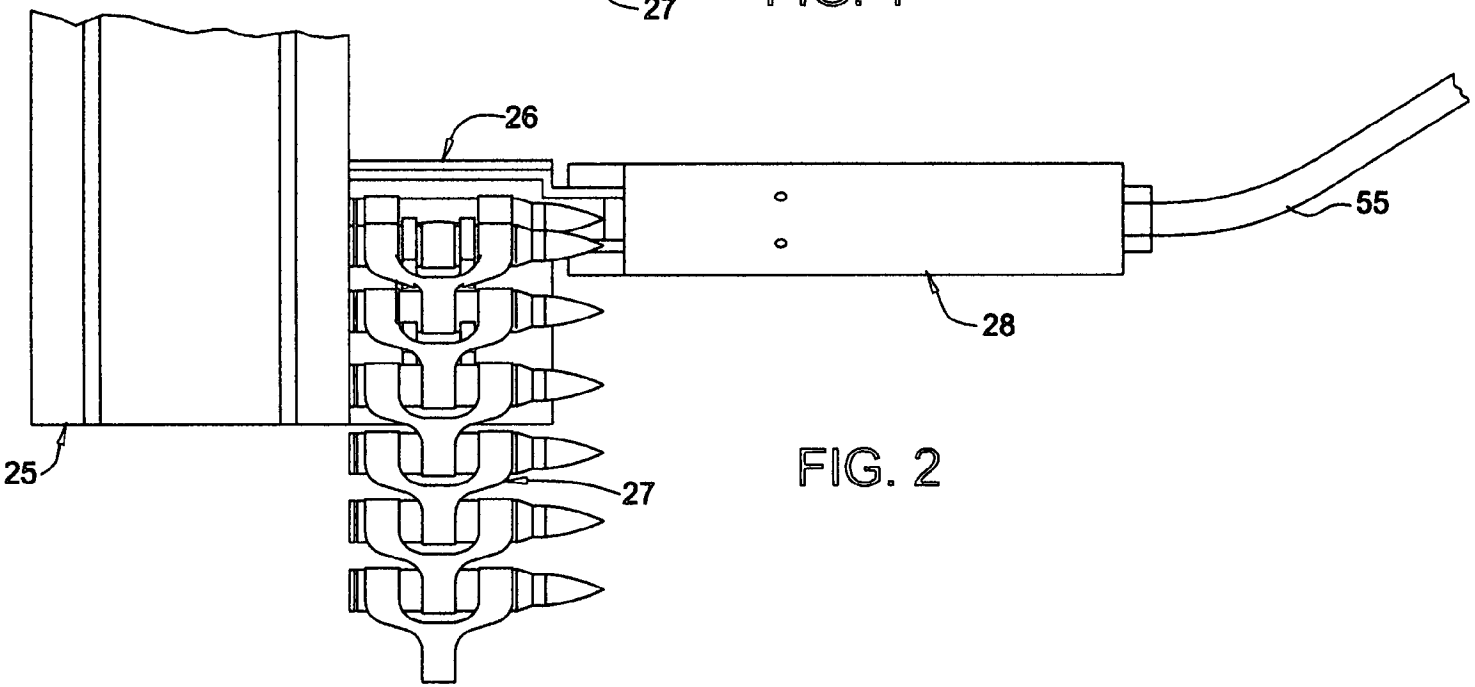
FIG. 2 is an enlarged side elevational view of the attachment shown in FIG. 1.
Figure 4:
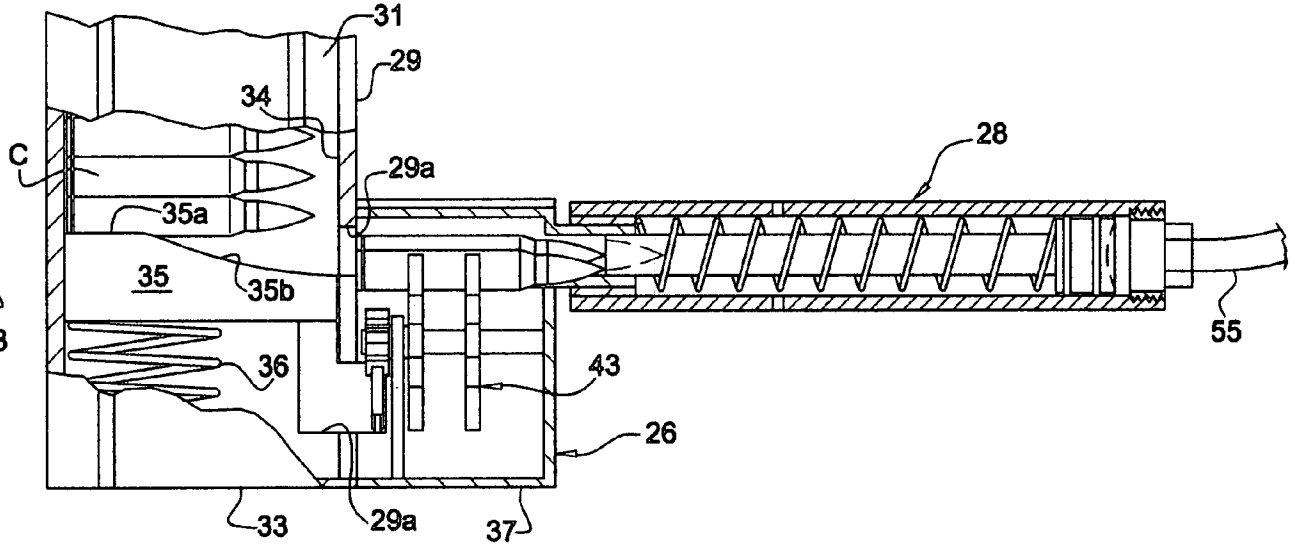
FIG. 4 is a cross-sectional view taken along line 4-4 in FIG. 3, having portions thereof removed to disclose the interior thereof.
Figure 3:
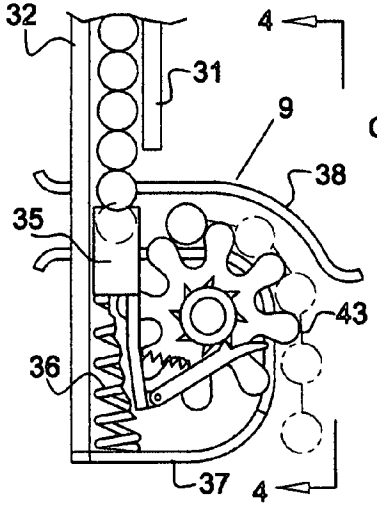
FIG. 3 is a rear end view of the attachment shown in FIG. 2, having a rear wall thereof removed, illustrating a cartridge of the cartridge belt in position to be injected into the magazine.

Referring to the drawings, there is illustrated a firearm 20 equipped with an attachment 21 which embodies the present invention. The firearm is of a conventional design including a receiver 22 including a cartridge chamber, a firing chamber and a trigger mechanism 23 and a barrel 24. Attachment 21 includes a magazine 25 attachable to receiver 22 for feeding cartridges into the cartridge chamber thereof, a housing 26 mounted on magazine 25 for supporting a cartridge feed belt 27 and a cartridge injector device 28. Magazine 25 has a substantially rectangular configuration including front and rear walls 29 and 30, a pair of side walls 31 and 32 and a bottom wall 33 defining a chamber 34 opening at an upper end and communicating with the cartridge chamber of receiver 22 when the magazine is attached to the receiver. As best shown in FIG. 4, the lower end of front wall 29 has a first opening 29*a* communicating with an upper end of housing 26 and an opening 29*b* communicating with a lower end of housing 26. Disposed in the lower end of chamber 34 is a follower 35 which is displaceable along a first line of travel disposed substantially parallel to front and rear walls 30 and 31 of the magazine. Follower 35 is seated on a coil spring 36 which is supported on bottom wall 33 of the magazine. Adapted to be supported on follower 35 is a stack of cartridges C which are caused to be displaced upwardly by follower 35 under the biasing action of spring 36, into the cartridge chamber in the receiver, aligned with the firing chamber thereof. Follower 35 has a first surface 35*a* which engages a rearwardmost cartridge of the stack of cartridges, in urging the uppermost cartridge into the cartridge chamber of the receiver, and a sloped or ramp surface 35*b* extending downwardly toward the bottom edge of side wall opening 29*a*.

Housing 26 includes a bottom wall 37 which substantially forms a continuation of magazine bottom wall 33 and curves upwardly and inwardly, laterally, beyond magazine side wall 32. Wall 37 further is provided with an opening as indicated at 37*a*. The housing further is provided with an upper wall 38 spaced from the upper end of curved wall member 37 to provide a curved passageway 39 between the upper end of curved wall member 37 and upper wall member 38. Such channel extends beyond magazine side wall 32. Housing 26 further is provided with a front end wall 40 and a wall 41 spaced from and disposed between end wall 40 and magazine front wall 29.

Figure 8:
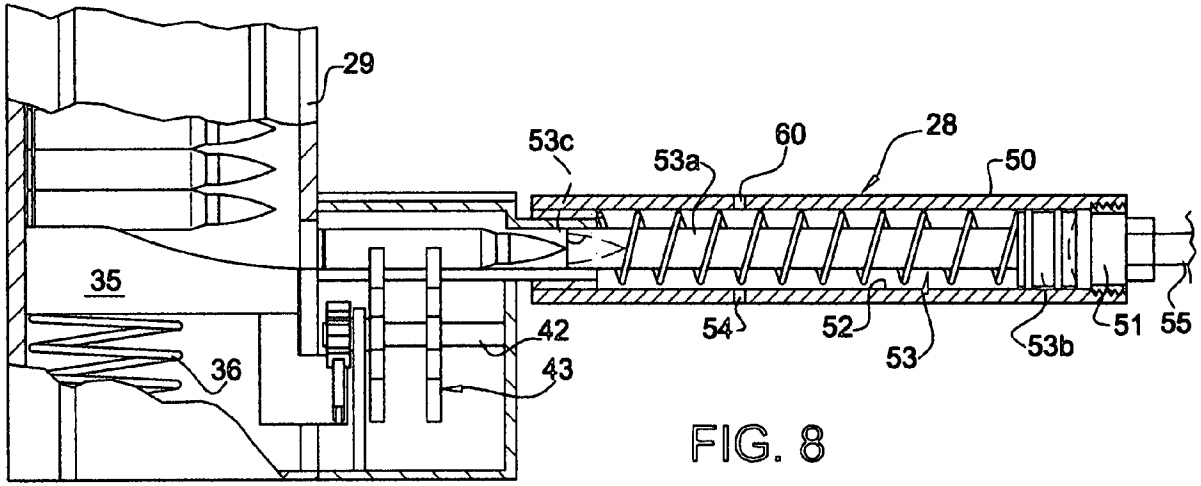
FIG. 8 is a cross-sectional view taken along lines 8-8 of FIG. 7, having a portion thereof removed to disclose the interior thereof.
Figure 7:
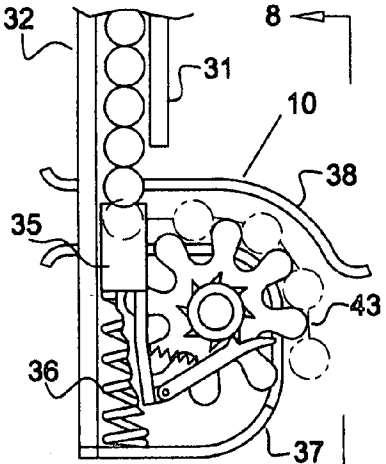
FIG. 7 is a view similar to the views shown in FIGS. 3 and 5, illustrating a further sequence of operation in which the cartridge injected into the magazine has been displaced by the follower in a direction towards the cartridge chamber of the firearm.
Figure 10:
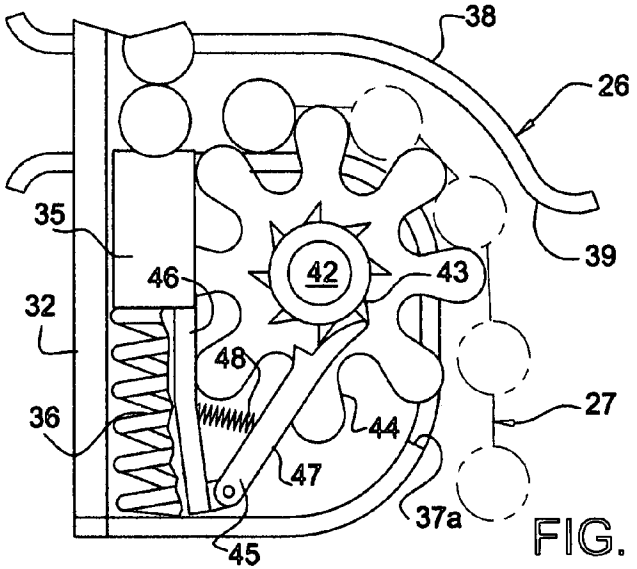
FIG. 10 is an enlargement of that portion of the attachment shown in FIG. 6, designated by the reference numeral 10.
Figure 9:
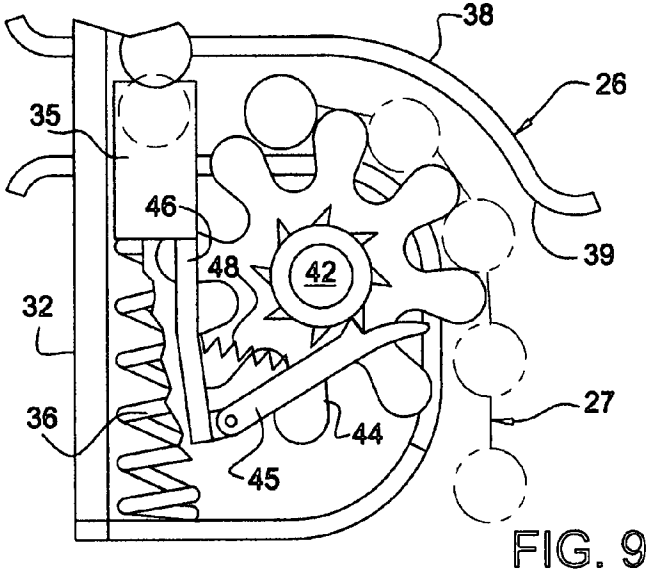
FIG. 9 is an enlargement of that portion of the attachment shown in FIG. 3, designated by the reference numeral 9.

Journaled in spaced walls 40 and 41 within housing 26 is a shaft 42 of a sprocket 43. As best shown in FIGS. 9 and 10, sprocket 43 has a plurality of circumferentially spaced recesses 44 which are adapted to receive cartridges of cartridge belt 27 inserted in arcuate passageway 29 and trained over the sprocket to index a cartridge in a position as shown in FIG. 8 in alignment with the second line of travel intersecting follower 35 and the rearwardmost cartridge in magazine 35, disposed substantially perpendicular to the first line of travel of the cartridges in the magazine urged by follower 35 into the cartridge chamber of the firearm receiver under the influence of spring 36. Cartridges of belt 27 received in the recesses of the sprocket are caused to index about the axis of shaft 42 by means of a pawl and ratchet mechanism 45 actuated by displacement of follower 35. Such mechanism includes a ratchet 43 mounted on shaft 42 and consisting of a set of circumferentially spaced teeth, an arm member 46 depending from follower 35, a pawl 47 pivotally connected at one end to the free end of depending arm member 46 and operatively engaging the teeth of ratchet 43 at an opposite end thereof, and a spring 48 urging pawl 47 into engagement with the teeth of the ratchet.

Injector mechanism 28 includes a cylindrical member 50 supported at one end on and communicating with the interior of the upper end of housing 26 through an opening in the upper end of housing end wall 40, and closed at opposite end thereof by an end wall 51, providing a cylindrical chamber 52 communicating with the interior of the upper end of sprocket housing chamber 26. Disposed within chamber 52 is a piston 53 having a rod portion 53*a* and a head portion 53*b*. The free end of rod portion 53*a* is guided in a restrictive end portion of cylindrical member 50 and is provided with a recess 53*c* which is configured similarly to and adapted to receive the nose portion of an aligned cartridge of the cartridge belt disposed along the second line of travel intersecting follower 35 and the rearwardmost cartridge in magazine 25. Disposed between the restricted portion of cylindrical member 50 and piston head 53*b* is a coil spring 54 which functions to bias piston 53 in a retracted position against end wall 51 as shown in FIG. 8. End wall 51 further is provided with an opening communicating with that portion of chamber 52 between piston head 53*b* and end wall 51. A conduit 55 provides a gas passageway intercommunicating muzzle 24 adjacent the free end thereof and that portion of chamber 52 between piston head 53*b* and end wall 51.

Figure 6:
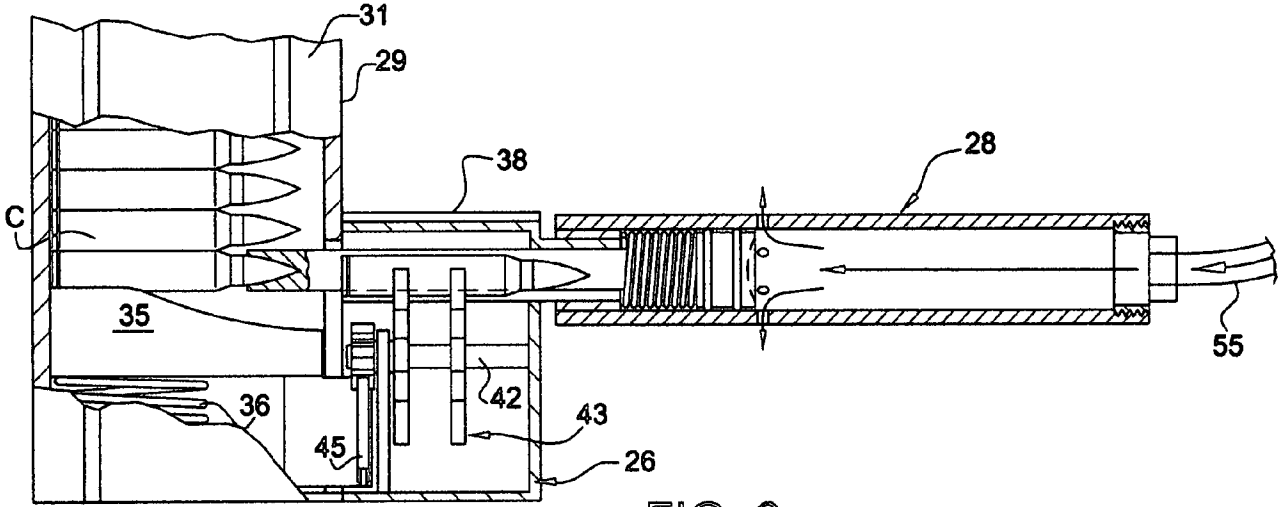
FIG. 6 is a cross-sectional view taken along 6-6 in FIG. 5, having a portion thereof removed to illustrate the interior thereof.
Figure 5:
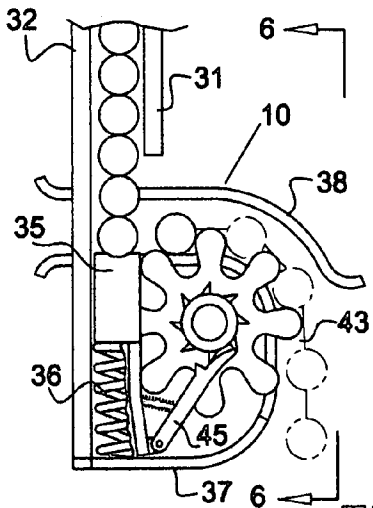
FIG. 5 is a view similar to the view shown in FIG. 3, illustrating a sequence of operation of the attachment in which a cartridge from the cartridge belt has been injected into the magazine.

In the operation of the attachment as described, when a stack of cartridges is inserted into magazine 25, magazine 25 is attached to the firearm receiver, conduit 25 is connected to the muzzle adjacent the free end thereof and a cartridge belt is fed into housing 26 to position a cartridge along the line of travel intersecting follower 35 and the rearwardmost cartridge in the magazine and the trigger mechanism is actuated to fire a round in the firing chamber, the gases produced in the muzzle by the fired round will be transmitted through conduit 28 to injector mechanism 28 to cause piston 53 to extend, engaging and displacing a cartridge in the position as shown in FIG. 8 into the magazine between follower 35 and the rearwardmost cartridge in the magazine. As such cartridge is injected into the magazine, its insertion between the follower and the rearwardmost cartridge in the magazine is facilitated by the sloped or ramp surface 35*b*. Furthermore, as such cartridge is injected into the magazine, the follower will be caused to displace downwardly against the biasing action of spring 36, as shown in FIGS. 5, 6 and 10. As the follower displaces downwardly and then upwardly under the action of spring 36, the follower causes the pawl of mechanism 45 to displace downwardly to the position as shown in FIG. 10 and then upwardly to the position as shown in FIG. 9, causing the free end of the pawl to engage the teeth of the ratchet and thus rotationally index sprocket 43. As the sprocket rotationally indexes, it correspondingly indexes a cartridge of the cartridge belt into the position as shown in FIG. 8. As piston 53 fully extends as shown in FIG. 6 to insert a cartridge from the cartridge belt into the magazine between follower 35 and the rearwardmost cartridge in the magazine, the head portion of the piston extends beyond a series of vent holes 60 causing the gases displacing the piston to escape from chamber 52 and thus remove the force acting on piston 53. Upon the venting of such gases, the force of spring 54 will cause the piston to retract to the position as shown in FIGS. 4 and 8.

The attachment as described may consist of the magazine 25, the sprocket housing 26, the injector mechanism 28 and the conduit 55 or simply the sprocket housing 26, the injector mechanism 28 and conduit 55 having means to mount the sprocket housing on magazine 25 and modifying magazine 25 to accommodate the mounting of sprocket housing 26 and connecting the pawl of the pawl and ratchet mechanism to the follower of the magazine. In such later described embodiment, the firearm could optionally be used with either a conventional magazine minimally modified or an attachment as described to accommodate a cartridge belt.

Figure 11:
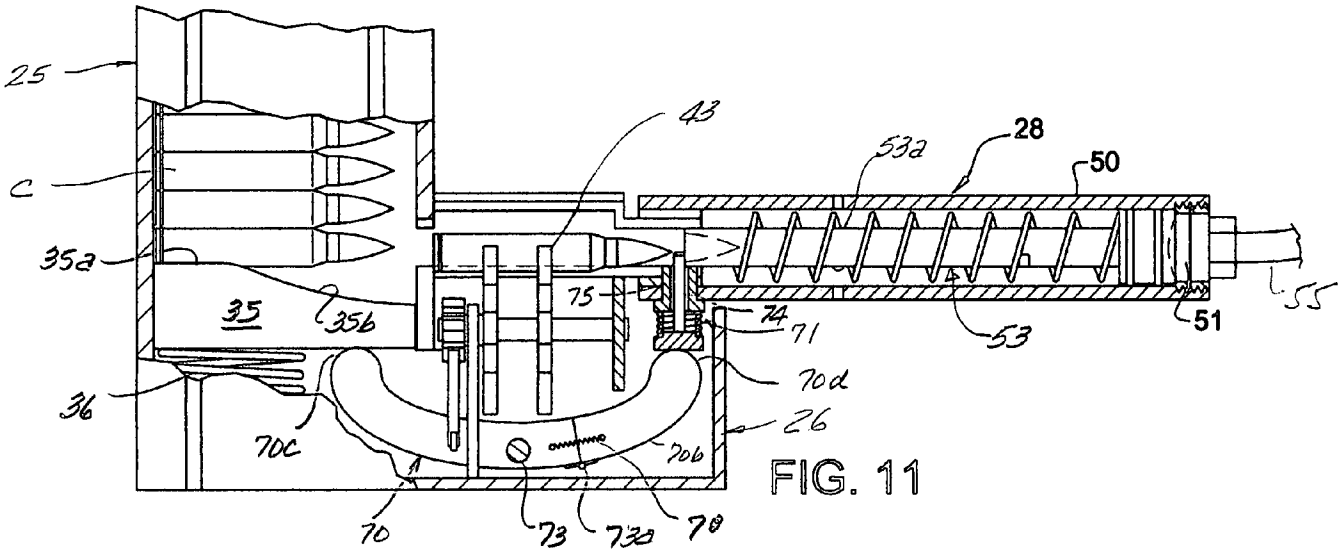
FIG. 11 is a view similar to the view shown in FIG. 8 in which there is provided a mechanism for precluding the unintended displacement of the member displacing a round from a feed belt into the magazine of the firearm, into engagement with an aligned round in the magazine, shown in an operative condition.

FIGS. 11 through 14 illustrate a modified portion of the attachment shown in FIGS. 1 through 10, providing a mechanism 70 operable to prevent the inadvertent or unintentional displacement of piston 53, causing a round in the feed belt to be propelled against an aligned round in the magazine and the detonation of the propelled round. The mechanism generally consists of a blocking pin assembly 71 disposed within housing 26 and a curved lever 72 disposed within the lower end of magazine 25 and housing 26, pivotally mounted on a transversely disposed pin 73 and engaging at opposite ends thereof to the underside of follower 35 and pin assembly 71. Pin assembly 71 consists of a pin 74 guided along a line of travel essentially disposed perpendicular to the longitudinal line of travel of piston 53, by means of a cylindrical guide member 75, having a head portion 76 and a spring 77 disposed between a lower, angular flange portion of guide member 75 and head portion 76 for urging pin 74 downwardly out of the loading chamber. Lever 70 includes a first section 70*a* and a connected section 70*b*. Lever section 70*a* is pivotally connected on transversely disposed pin 73 secured to the side walls of housing 26. It further is provided with a rounded end portion 70*c* which engages the underside of follower 35. Lever section 70*b* is pivotally connected to an end of lever section 70*a*, opposite rounded end portion 70*c*, by means of a hinge 73*a*, and is urged into engagement with lever section 70*a* to provide a continuously curved configuration by means of a set of springs 78 mounted on opposite sides and interconnecting the two lever sections. Lever section 70*b* further is provided with a rounded end portion 70*d* which engages the underside of head portion 76 of pin 74. The combined strengths of springs 78 is greater than the strength of spring 77 so that when follower 35 is in its lowermost position as shown in FIG. 11, lever section 70*b* will be caused to be in curved continuous relation with lever section 70*a* and the lever will pivot about rod 73 against the biasing action of spring 77 to displace pin 74 upwardly into the loading chamber when the piston is in the retracted position, to block the displacement of the rod portion of the piston to inadvertently propel a round from the feed belt into the magazine, into engagement with an aligned round in the magazine.

Figure 12:
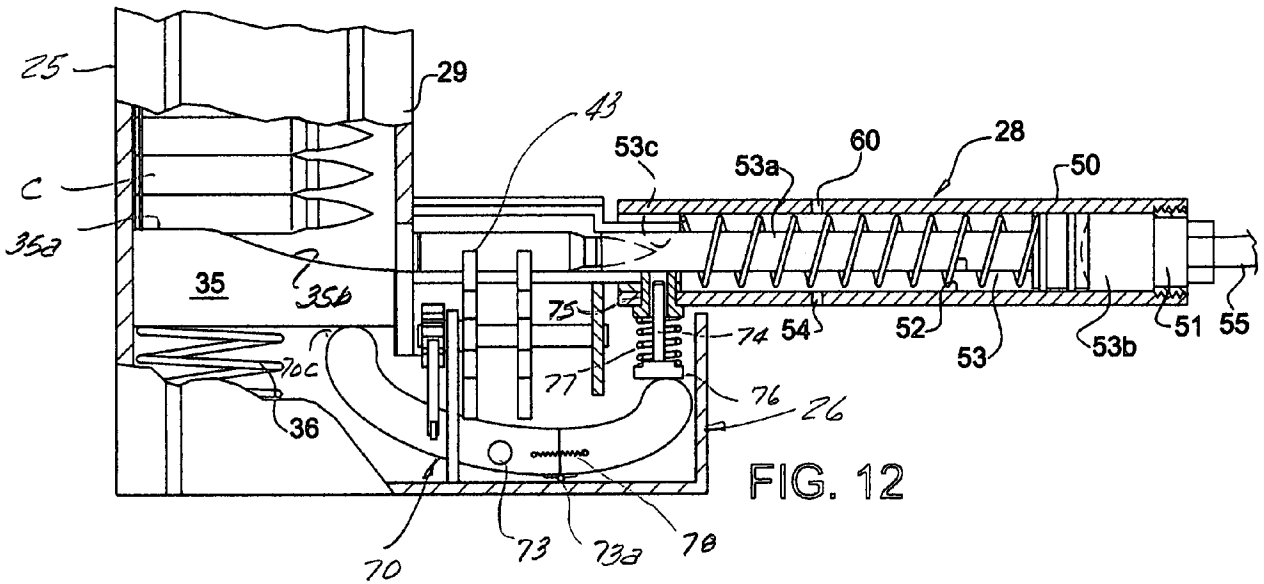
FIG. 12 is a view similar to the view shown in FIG. 11, illustrating the mechanism in a subsequent, inoperative sequence.
Figure 13:
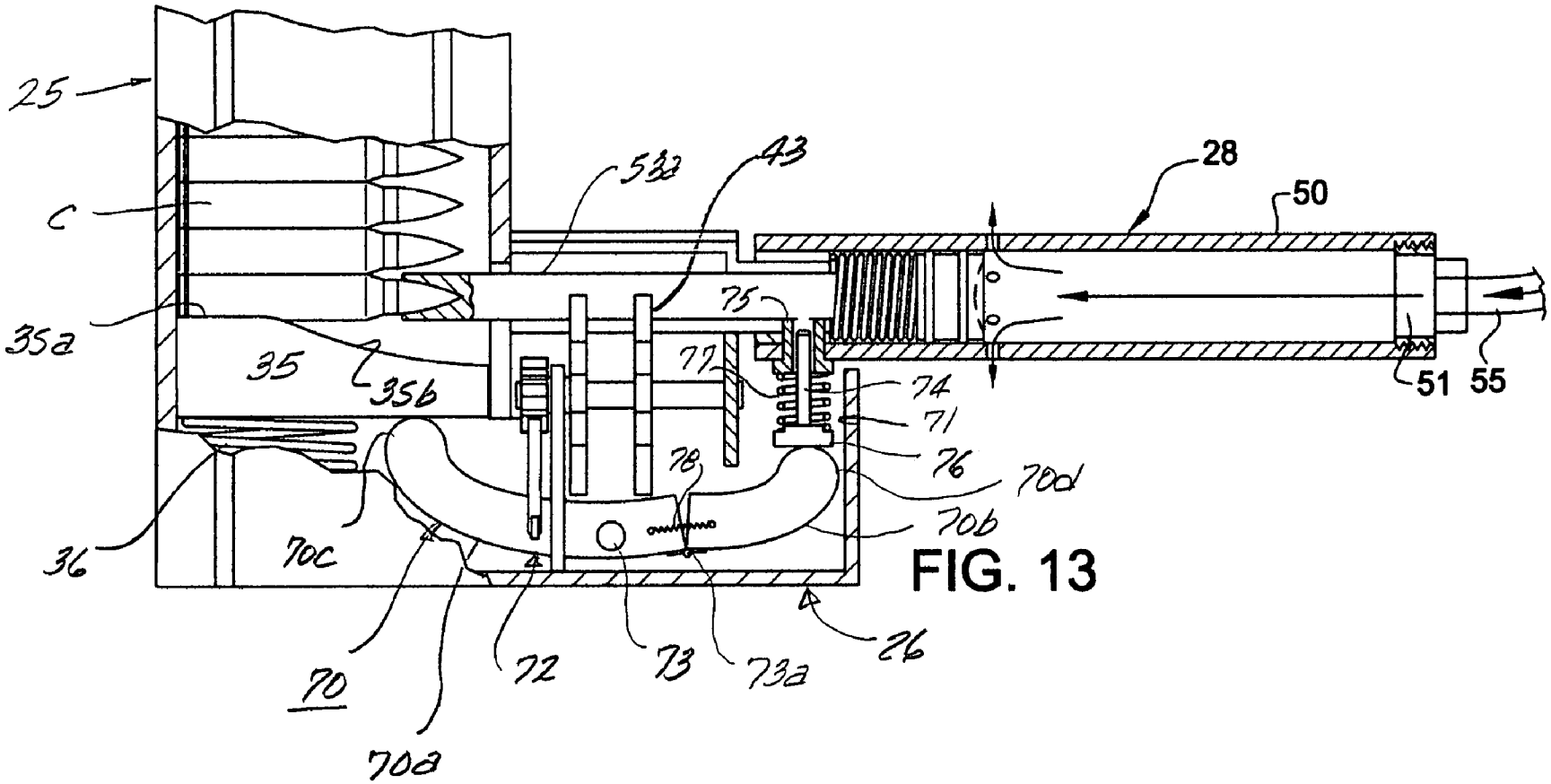
FIG. 13 is a view similar to the view shown in FIGS. 11 and 12, illustrating the mechanism in a still further inoperative sequence.

In the operation of the safety mechanism as shown in FIGS. 11 through 13, when piston 53 is in the retracted position as shown in FIG. 11, the depressed position of follower 35, against the biasing action of spring 36, will cause lever 70 in its intact condition due to the biasing action of springs 78 to pivot in a counterclockwise direction to displace pin 74 upwardly, against the biasing action of spring 77, into the loading chamber and the path of rod portion of 53*a* of piston 53, thus blocking any inadvertent or unintentional extension of piston 3 tending to propel a round in the feed belt against an aligned round in the magazine, causing a detonation of the round being fed from the feed belt. Whenever a round in the chamber of the fire arm is fired, causing a generation of gases transmitted to the piston for operating the piston to feed another round from the feed belt to the magazine, the upward movement of follower 35 under the biasing action of spring 36, will cause lever 70 in its intact condition to pivot in a clockwise direction, relieving the force against pin 74 and thus permitting pin 74 to retract under the biasing action of spring 77, to a condition as shown in FIG. 12, permitting the piston to advance and thus insert a round from the feed belt into the magazine. As such round is inserted into the magazine and engages curved surface 35*b* of the follower, the follower is caused to retract downwardly against the biasing action of spring 36. As such downward movement of the follower occurs, lever section 70*a* also will be caused to pivot in a clockwise direction about pivot pin 73. As such section thus pivots, lever section 70*b* is precluded from pivoting along with it but is permitted to pivot relative to lever section 70*a* about the axis of hinge connection 73*a* against the biasing action of springs 78. Lever section 70*b* is precluded from pivoting in a clockwise direction along with lever section 70*a* because of the obstruction of pin 74 by rod portion 53*b* of piston 53 in the loading chamber as shown in FIG. 13. Once the rod portion of the piston is retracted from the loading chamber under the influence of coil spring 54, springs 78 will cause lever section 70*b* to again engage lever section 70*a* thus becoming intact therewith and further causing pin 74 to be displaced upwardly into the loading chamber, against the action of spring 77, to the position as shown in FIG. 11. Under such conditions, the pin will remain in the path of the rod section of piston 53 to preclude the displacement thereof until the next round is fired in the firearm.

Although a lever type of arrangement as described may be provided to provide an obstruction to the inadvertent or unintentional displacement of the feeding piston, it is contemplated within the scope of the invention to provide other, comparable mechanisms for achieving the same purpose. The mechanism essentially being simply a mechanism for obstructing the extension of the feed piston unless propelled by the application of a force produced by the generation of expanding gases emanating from the muzzle of the firearm.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A cartridge feeding attachment for a firearm having a cartridge chamber and a muzzle comprising:

a housing attachable to said firearm having means for guiding a stack of cartridges sequentially into said cartridge chamber along a first line of travel intersecting said cartridge chamber, a follower engageable with a rearmost one of said stack of cartridges and means disposed between said housing and said follower for biasing said follower along said first line of travel to feed a foremost one of said stack of cartridges into said cartridge chamber, when said housing is attached to said firearm;

a sprocket supported on said housing having a plurality of circumferentially spaced recesses each receiving a cartridge of a cartridge belt trained over said sprocket, and a rotational axis positioned so that upon rotational indexing thereof, a cartridge of said cartridge belt will be positioned along a second line of travel extending between said follower and said rearmost cartridge of said stack of cartridges;

means displaceable along said second line of travel between a retracted position out of engagement with a cartridge of said cartridge belt positioned along said second line of travel and an extended position engaging and displacing said cartridge between said follower and said rearmost cartridge of said stack of cartridges;

means for biasing said displaceable means in said retracted position;

means for transmitting the force of expanding gases resulting from the firing of a cartridge in said firearm to said displaceable means, operable for displacing said displaceable means between said retracted and extended positions, against the action of said biasing means; and means responsive to displacement of said follower upon actuation of said displaceable means for rotationally indexing said sprocket to correspondingly position another cartridge of said cartridge belt along said second line of travel.

2. An attachment according to claim 1 wherein said housing comprises a cartridge magazine.

3. An attachment according to claim 1 wherein said first mentioned biasing means comprises a spring.

4. An attachment according to claim 1 wherein said follower includes a first surface engageable with said rearmost one of said stack of cartridges, disposed in a plane substantially perpendicular to said first line of travel, and a second surface disposed at a substantially acute angle to the plane of said first surface, facilitating the insertion of a cartridge positioned on said sprocket, between said follower and said rearmost one of said stack of cartridges.

5. An attachment according to claim 1 wherein said second mentioned biasing means comprises a spring.

6. An attachment according to claim 1 wherein said force transmitting means comprises means defining a passageway intercommunicating said muzzle and an end of said displaceable means, for conducting expanding gases produced by the firing of a cartridge in said firearm.

7. An attachment according to claim 6 wherein said passageway communicates with said muzzle adjacent a free end of said muzzle.

8. An attachment according to claim 1 wherein said displaceable means comprises a piston disposed in an elongated chamber.

9. An attachment according to claim 8 wherein said second mentioned biasing means comprises a spring acting on said piston.

10. An attachment according to claim 8 wherein said force transmitting means comprises means defining a passageway intercommunicating said muzzle and said piston chamber.

11. An attachment according to claim 10 wherein said passageway communicates with said muzzle adjacent a free end thereof.

12. An attachment according to claim 1 wherein said sprocket indexing means comprises a pawl and ratchet mechanism.

13. An attachment according to claim 12 wherein said mechanism is actuated by a movement of said follower along said first line of travel.

14. An attachment according to claim 13 wherein said follower movement occurs during a movement of said follower under the biasing force of said first mention biasing means.

15. An attachment according to claim 12 wherein the teeth of said ratchet are disposed on said sprocket, spaced circumferentially relative to the rotational axis of such sprocket, and said pawl is pivotally connected to said follower.

16. An attachment according to claim 1 wherein said second line of travel is substantially perpendicular to said first line of travel and said rotational axis of said sprocket is substantially parallel to said second line of travel.

17. An attachment according to claim 8 wherein an end of said piston includes a recess in which a nose portion of a cartridge disposed along said second line of travel may be received.

18. An attachment according to claim 17 wherein said recess is configured similarly to the configuration of the nose of said cartridge aligned therewith.

19. An attachment according to claim 8 wherein the means defining said elongated chamber includes venting holes communicable with said chamber when said piston is in its fully extended position.

20. An attachment for a firearm having a cartridge chamber, a muzzle and a cartridge magazine provided with a passageway for guiding a stack of cartridges along a first line of travel, a follower engageable with a rearmost one of said stack of cartridges and means disposed between said magazine and said follower for biasing said follower along said first line of travel to feed a foremost one of said stack of said cartridges into said chamber, comprising:

a housing attachable to said magazine;

a sprocket supported on said housing having a plurality of circumferentially spaced recesses each receiving a cartridge of a cartridge belt trained over said sprocket, and a rotational axis positioned when said housing is attached to said magazine so that upon rotational indexing thereof, a cartridge of said cartridge belt will be positioned along a second line of travel extending between said follower and said rearmost cartridge of said stack of cartridges;

means supported on said sprocket housing, displaceable along said second line of travel between a retracted position out of engagement with a cartridge of said cartridge belt positioned on said second line of travel and an extended position engaging and displacing said cartridge between said follower and said rearmost cartridge of said stack of cartridges;

means for biasing said displaceable means in said retracted position;

means for transmitting the force of expanding gases resulting from the firing of a cartridge in said firearm to said displaceable means, operable for displacing said displaceable means between said retracted and extended positions against the action of said biasing means; and means responsive to a displacement of said follower for rotationally indexing said sprocket and correspondingly positioning another cartridge of said cartridge belt along said second line of travel.

21. An attachment according to claim 1 including means for precluding the extension of said displacing means, operable to disable responsive to an indexing of a cartridge of said stack of cartridges, permitting said displacing means to extend and thus displace a cartridge from said cartridge belt to said housing between said follower and said rearmost cartridge.

22. An attachment according to claim 21 wherein said precluding means includes a pin extendable into and retractable out of a path of travel of said displacing means, and a lever pivotally mounted on said housing having an end portion engaging said pin for movement therewith and an opposite end engaging said follower for movement therewith.

23. An attachment according to claim 22 wherein said ends of said lever are rounded.

24. An attachment according to claim 22 wherein said lever is curved.

25. An attachment according to claim 22 including means interposed between a component of said housing and a head portion of said pin, biasing said pin in said retracted.

26. An attachment according to claim 25 wherein said lever includes a first section pivotally connected to said housing having an end portion engaging said follower for movement therewith, and a second section hingedly connected to said first lever section for angular displacement relative thereto between a closed, abutting relationship and an open spaced relationship, and an end portion engaging said pin for movement therewith, and means interconnecting said lever sections biasing said section into said closed, abutting relationship.

27. An attachment according to claim 26 wherein said second mentioned biasing means exerts a greater force than said first mentioned biasing means.

28. An attachment according to claim 27 wherein said lever sections are curved.

29. An attachment according to claim 28 wherein said ends of said lever sections are rounded.

* * * * *

UNITED STATES PATENT AND TRADEMARK OFFICE

CERTIFICATE OF CORRECTION

PATENT NO. : 7,568,421 B2
APPLICATION NO. : 11/604295
DATED : August 4, 2009
INVENTOR(S) : Cummings It is certified that error appears in the above-identified patent and that said Letters Patent is hereby corrected as shown below:

Col. 6, line 47-48, remove the paragraph break after "dis-placeable" thereby providing the following --dis-placeable means between said retracted and extended positions, against the action of said biasing means; and--

Col. 8, line 44, after "retracted" add --position--

Signed and Sealed this

Sixth Day of July, 2010

David J. Kappos

David J. Kappos
*Director of the United States Patent and Trademark Office*